US006561065B2

(12) United States Patent
Ranalli

(10) Patent No.: US 6,561,065 B2
(45) **Date of Patent: *May 13, 2003**

(54) HOLLOW BODY HOLE PUNCHING APPARATUS, SYSTEM, AND METHOD

(76) Inventor: James M. Ranalli, 329 Churchill Rd., Venetia, PA (US) 15367

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/561,008

(22) Filed: Apr. 28, 2000

(65) Prior Publication Data

US 2003/0033917 A1 Feb. 20, 2003

(51) Int. Cl.[7] ..... B21D 28/04; B21D 28/28

(52) U.S. Cl. ..... 83/36; 83/54; 83/167; 83/180; 83/184; 83/192; 83/195; 83/456; 83/687

(58) Field of Search ..... 83/54, 180, 181, 83/182, 184, 195, 559, 560, 561, 562, 34, 35, 36, 50, 167, 178, 179, 183, 188, 192, 193, 451, 452, 453, 456, 563, 623, 685, 686, 687, 690; 269/48.1; 72/326, 327

(56) References Cited

U.S. PATENT DOCUMENTS

| | | | | |
|---|---|---|---|---|
| 1,241,257 A | * | 9/1917 | Wurts et al. | 83/560 X |
| 3,209,575 A | | 10/1965 | Woodward, Jr. et al. | 72/335 X |
| 3,266,352 A | * | 8/1966 | Kuts | 83/623 X |
| 3,368,255 A | | 2/1968 | Cotton | 83/188 |
| 3,678,718 A | | 7/1972 | Brown et al. | 72/71 |
| 3,698,274 A | | 10/1972 | Coulon et al. | 83/188 |
| 3,777,601 A | * | 12/1973 | Strandell | 83/562 X |
| 3,815,399 A | | 6/1974 | Foulks et al. | 72/186 |
| 3,880,415 A | * | 4/1975 | Fujioka et al. | 269/48.1 |
| 4,744,276 A | | 5/1988 | Duce | 83/50 |
| 5,140,881 A | | 8/1992 | Aizaki et al. | 83/191 |
| 6,128,991 A | | 10/2000 | Nakagawa et al. | 83/181 |

* cited by examiner

*Primary Examiner*—Clark F. Dexter
(74) *Attorney, Agent, or Firm*—Metz Lewis LLC; Thomas Lizzi; Barry I. Friedman

(57) ABSTRACT

An apparatus, system, and method for punching holes at any location along the length of an elongate hollow body comprising an expandable die which is insertable into the elongate hollow body. The elongate hollow body may have any shape and be of any length. In operation, the expandable die cooperates with the punch or punches of an external, conventional punch press. The expandable die self-aligns its die cavity or cavities with the punch or punches of the external punch press. The expandable die can expand to support the elongate hollow body during the punching operation to avoid denting or other damage to the elongate hollow body.

12 Claims, 7 Drawing Sheets

HOLLOW BODY HOLE PUNCHING APPARATUS, SYSTEM, AND METHOD

BACKGROUND OF THE INVENTION

1. Field of the Invention

The invention relates to an apparatus, system, and method for punching holes in the walls of elongate hollow bodies. In particular, the invention relates to an apparatus, system, and method for die punching holes in the walls of elongate hollow bodies by use of an expandable die which is insertable into the elongate hollow body and positionable anywhere along the length of the elongate hollow body.

2. Description of the Prior Art

There has long existed a need to be able to economically and reliably die punch holes at desired locations along the length of elongate hollow bodies. For example, in the architectural glass industry, elongate hollow bodies in the form of aluminum mullions up to thirty feet in length are used for supporting panels of architectural glass. Cross-members and associated hardware are attached to the mullions by way of fasteners such as screws and bolts. The holes in the mullions for receiving the fasteners must be precisely located and reliably sized to provide for the fit and structural integrity necessary for the assembled architectural structure. Moreover, the mullion surface is often exposed to view making its surface finish an aesthetically important feature.

Two methods have been commonly employed for making the holes in such mullions. One way is to make the holes by use of a rotary tool such as drilling or routering. Rotary tool hole-making can be done in a shop, but is time consuming and produces shavings which present cleanup problems. Rotary tool hole-making can also be done in the field, but the hole location is not as precise and the sizing as reliable as they are for shop-made holes. Furthermore, the surface of the mullion may become scratched or dented during such hole-making processes. Moreover, even when done in a shop, rotary tool hole-making is a relatively slow and expensive process and the hole shape is limited to being generally round.

The other commonly used way of making holes in a mullion is to use die punching in conjunction with an open body such as an open-side extrusion. This method requires that the mullion consists of two or more longitudinal pieces that may be joined together during service, but which during hole punching are separate and apart so that each piece has at least one open side. The open side permits the piece to be fit over a conventional punch die anvil. This method allows reliably sized holes of a desired shape to be die punched at precise locations along the length of the mullion. However, this method is not suitable for use with a single-piece elongate hollow body and the use of a multi-piece assembly is more expensive than the use of a single-piece extrusion.

There are other methods which have also been employed in the past for punching holes into elongate hollow bodies, but each of these has its own drawbacks. For example, Duce, U.S. Pat. No. 4,744,276, issued May 17, 1988, describes a method and an apparatus which use an exterior punch in combination with a die contained in a solid mandrel. This solid mandrel is inserted into the interior of a square tube with very little clearance. This method has the disadvantage that the mandrel must be sized to have a cross-section which approximates the interior cross-sectional dimensions of the elongate hollow body closely enough to avoid any collapse or deformation of the hollow body during the pressing operation. Thus, a separate mandrel is needed for each hollow body interior cross-section. Another disadvantage is that size variances and straightness irregularities in the interior of the elongate hollow body may make it difficult or impossible to employ this method. Woodward, U.S. Pat. No. 3,209,575, issued Oct. 5, 1965, also teaches the use of a solid mandrel, and, thus, is similarly disadvantaged.

Coulon et al., U.S. Pat. No. 3,698,274, issued Oct. 17, 1972, uses an exterior punch in combination with a die contained within a longitudinally split mandrel. The ends of the split-mandrel which are remote from the die are fixedly anchored. A wedge is forced between the two mandrel halves at their ends which are proximate to the die so as to make them engage the top and bottom interior surfaces of the tubular body that is to be punched. Although this method allows the same split-mandrel to be used for a range of tube diameters, it suffers from the obvious disadvantage of requiring the use of large amounts of material to make the mandrel and difficulties in supporting the mandrel for long elongate hollow bodies. Furthermore, this method is somewhat sensitive to the straightness of the interior of the hollow body.

Aizaki et al., U.S. Pat. No. 5,140,881, issued Aug. 25, 1992, describes an apparatus which uses an interior punch in combination with an exterior die to punch a hole in the sidewall of a cylinder from the inside out. The punch mechanism is contained within a sleeve tube that fits inside the cylinder that is to be punched. The punch mechanism consists of a radially-situated, floating punch, a bar-like cam supporting the floating punch, and a cylindrical member slidably inserted into the sleeve tube. The cylindrical member is attached to the bar-like cam at one end and at the other to a device which can axially reciprocate the cylindrical-member within the sleeve tube so as to cause the bar-like cam to force the floating punch radially outward through the cylinder wall and into the exterior die and then radially inward withdrawing the floating punch from the cylinder wall. Although this apparatus could conceivably be adapted to shapes other than cylinders, it has the disadvantage that the sleeve must be sized to closely approximate the interior size of the hollow body to be punched. Thus, uniformities in interior straightness and size of the hollow body are important constraints on the operation of this method. This method also has the disadvantage that, for long elongate hollow bodies, the punch mechanism is cumbersome and relatively expensive.

SUMMARY OF THE INVENTION

The present invention comprises a novel apparatus, system, and method for satisfying the need for economically and reliably punching holes along the length of elongate hollow bodies of any shape and length while overcoming the disadvantages inherent in the prior art devices described above.

The apparatus of the present invention comprises an expandable die that is insertable into the elongate hollow body. In operation, the expandable die cooperates with the punch or punches of an external conventional punch press. The expandable die is connected to the free end of a longitudinal member. The longitudinal member is hereinafter referred to as the positioning bar because it is used to longitudinally position the expandable die in relation to the punch or punches of the punch press. The distal end of the positioning bar is fixed in relation to the punch press. Preferably, the positioning bar is attached to a conventional support table and the attachment is made in a manner that allows for adjusting and then locking the longitudinal position of the expandable die with respect to the punch or punches of the punch press.

The expandable die is inserted into the elongate hollow body by sliding the hollow body through the gap between the expandable die and the punches of the punch press to the location where a hole or set of holes is to be punched. The expandable die has a die member which has one or more die cavities for receiving the punch or punches of the punch press. The cross-sectional shapes and sizes of the die cavities and the punches are made to produce the desired shape and size of hole or holes that are to be punched. Such cross-sectional shapes may be circular or non-circular so that a circular or a non-circular hole is punched, respectively. The expandable die also has a base member. The die and base members are designed so as to cooperate in supporting the elongate hollow body during the punching operation in a manner which prevents the elongate hollow body from becoming dented or otherwise damaged. Preferably, the outside surfaces of the die and base members are shaped to fit the contour of the corresponding inside surfaces of the elongate hollow body to better enable these members to provide sufficient support during the pressing operation to prevent the elongate hollow body from being deformed.

The expandable die also comprises an expansion mechanism, for example, without limitation, an expansion engine and a retractable support mechanism, for moving either or both of the die and base members outwardly to supportingly engage the adjacent inside surfaces of the hollow body during the punching operation and for moving either or both of these members inwardly after the punching operation has been completed. In the expanded position, which is also referred to herein as the activated position, the expandable die provides sufficient support to the elongate hollow body to prevent the punch or punches from denting or deforming the hollow body. In some embodiments this support is rigid and may be supplied in whole or in part by a retractable support mechanism. The expandable die also has at least one mechanism, for example, without limitation, an extendable piston, for laterally aligning the expandable die in relation to the punch or punches of the punch press. Preferably, the expandable die also comprises a receptacle for receiving the punch offal.

The system comprises an expandable single- or multiple-cavity die in combination with a conventional punch press having single or multiple punches. The system may also comprise a conventional static or roller table for supporting, backing or positioning the elongate hollow body.

When a support table is employed as part of a system according to the present invention, it is preferred that the support table include a guide for laterally positioning the elongate hollow body with respect to the punch or punches of the conventional punch press. The system may also include a mechanism for longitudinally moving the elongate hollow body after punching to the location where the next hole or set of holes is to be punched.

The method includes the steps of: (1) longitudinally aligning an expandable die with respect to at least one punch of a punch press, the expandable die having a die member and a base member and at least one die cavity in the die member for receiving the punch or punches of the punch press; (2) inserting the expandable die into an elongate hollow body; (3) activating the expandable die so that the die cavity or cavities become laterally aligned with the punch or punches and so that the die and base members of the expandable die come into supporting contact with the inside surfaces of the elongate hollow body; and (4) operating the punch press so that one or more holes are punched through the wall of the elongate hollow body. As used herein, the term supporting contact is used to mean that the die and base outer surfaces of the expandable die contact adjacent inside surfaces of the elongate hollow body in such a manner that the expandable die prevents the elongate hollow body from becoming dented or deformed during the pressing operation. After a hole or set of holes has been punched, the elongate hollow body can then be moved to the next position where a hole or set of holes are to be punched. Preferably, the expandable die is retracted after step (4) so as to make it easier to move the elongate hollow body in relation to the expandable die. As used herein, the term retract means to operate the expandable die in a manner which withdraws the lateral positioning mechanism and/or the die and/or base members of the expandable die from contact with the interior surfaces of the elongate hollow body sufficiently to allow the elongate hollow body to be moved with respect to the expandable die without causing damage to either the expandable die or the elongate hollow body.

Other features and advantages inherent in the subject matter claimed and disclosed will become apparent to those skilled in the art from the following detailed description of presently preferred embodiments thereof and to the appended drawings.

BRIEF DESCRIPTION OF THE DRAWINGS

The criticality of the features and merits of the present invention will be better understood by reference to the attached drawings. It is to be understood, however, that the drawings are designed for the purposes of illustration only and not as definition of the limits of the present invention.

DESCRIPTION OF PREFERRED EMBODIMENTS

Figure 1:
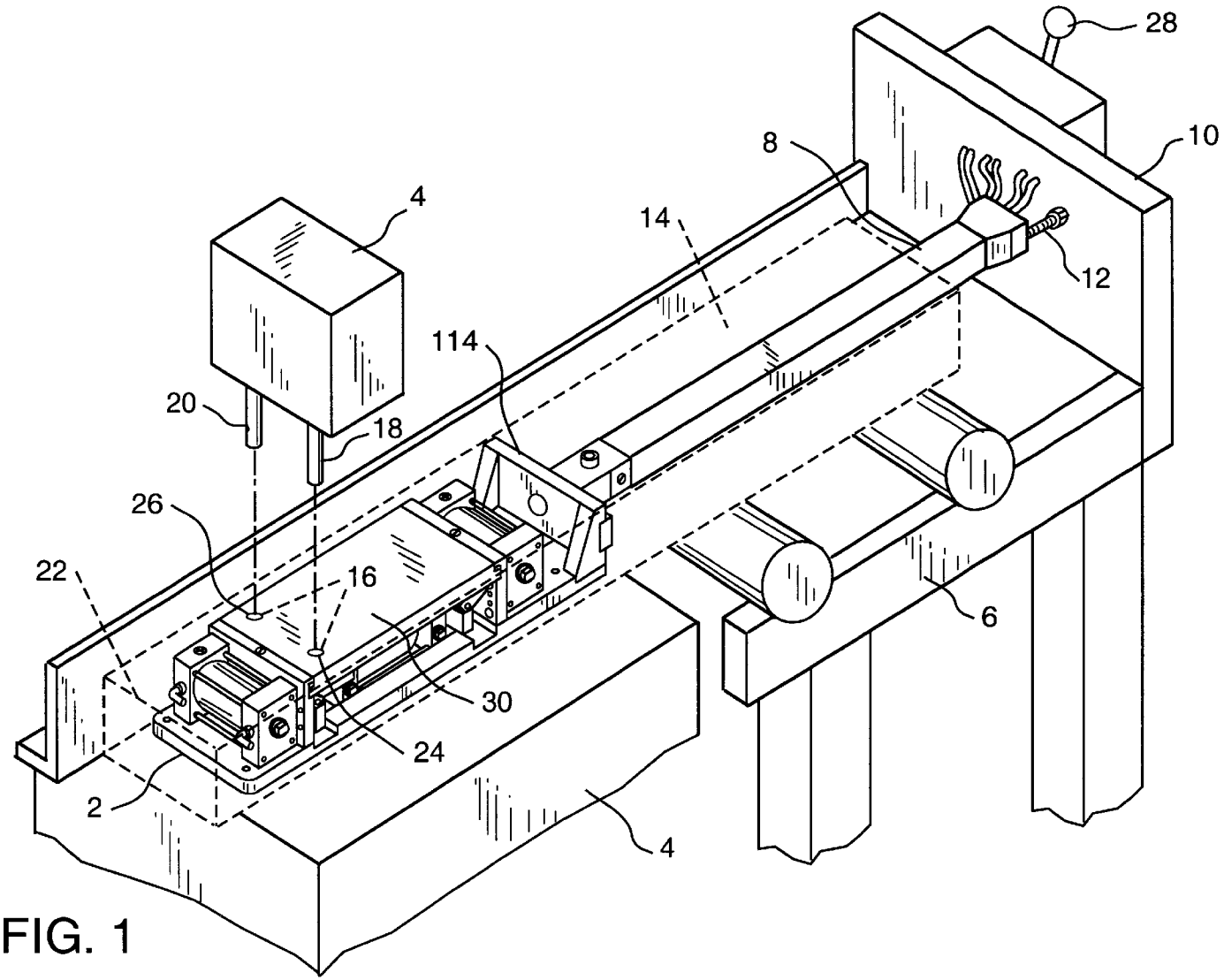
FIG. 1 is a perspective view of an embodiment of a hole punching system according to the present invention.

FIG. 1 illustrates an embodiment of the present invention which comprises, in combination, an expandable die 2, a conventional punch press 4, and a conventional roller table 6. Note that the conventional punch press 4 is shown symbolically in this figure. Expandable die 2 is connected to the free end of positioning bar 8. The other end of positioning bar 8 is attached to back support member 10 of table 6 by longitudinally adjustable connector 12. An elongate hollow body such as hollow body 14 may be perforated at any desired location along its length, such as location 16, by operating punch press 4 to cause first and second punches 18, 20 to press through top wall 22 of hollow body 14 into first and second die cavities 24, 26, respectively, of the die member 30 of expandable die 2 when expandable die 2 is in its activated state.

Figure 2:
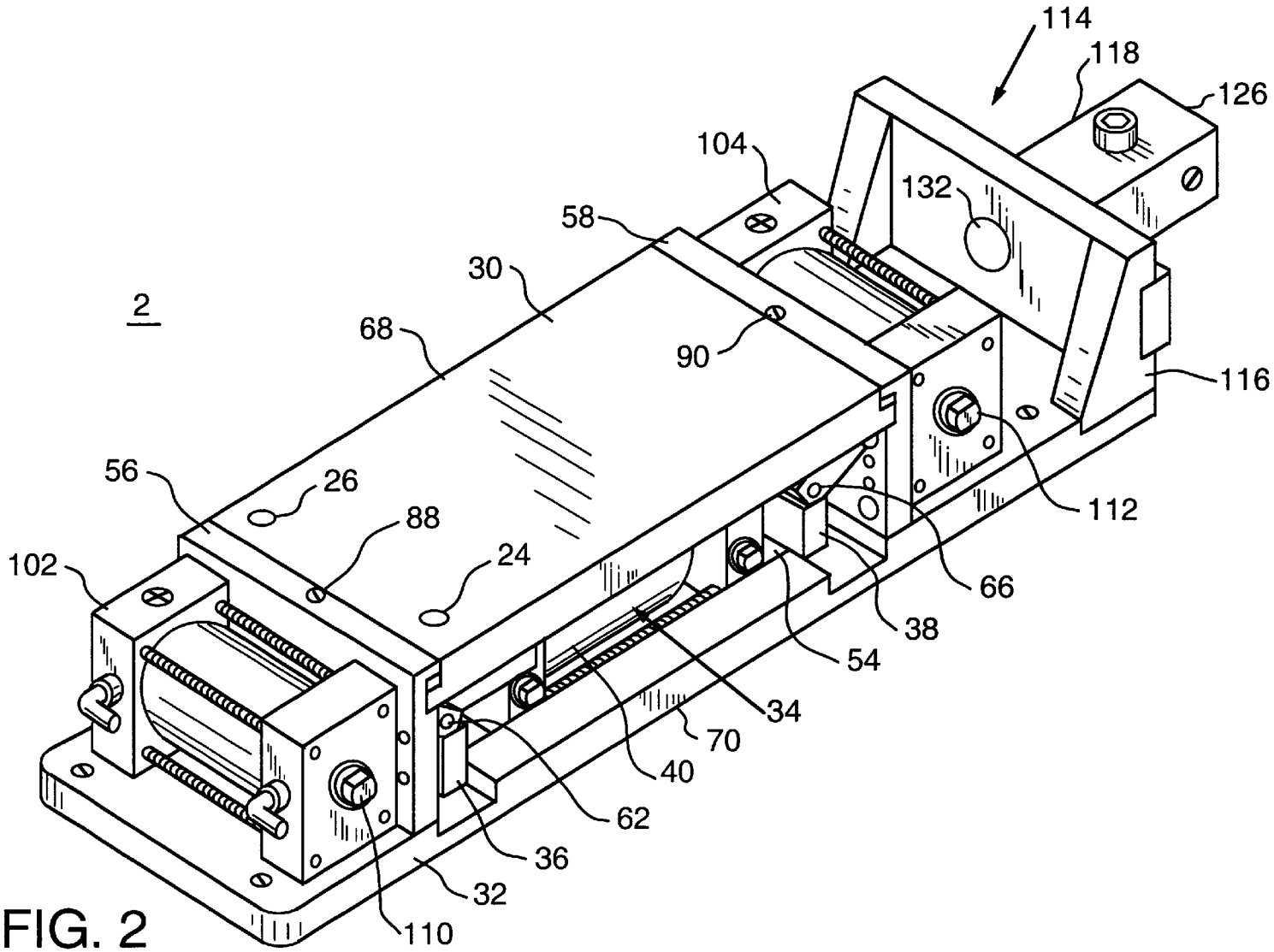
FIG. 2 is a perspective view of an expandable die according an embodiment of the present invention.
Figure 3A:
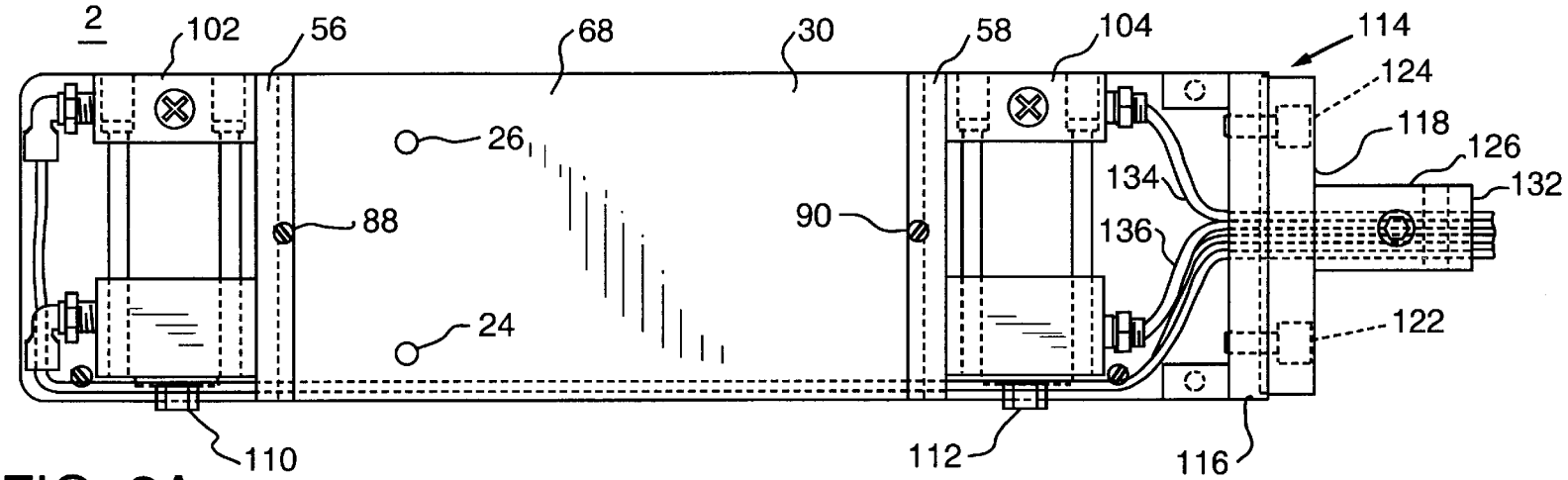
FIG. 3A is a top view of the expandable die shown in FIG. 2.
Figure 3B:
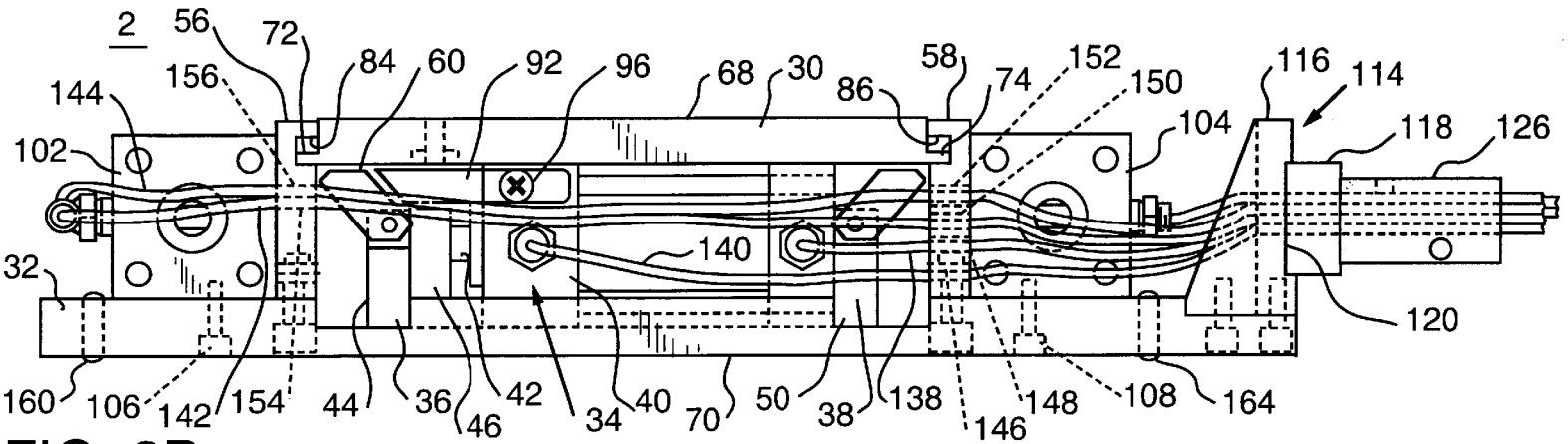
FIG. 3B is a side view of the expandable die shown in FIG. 2.
Figure 4:
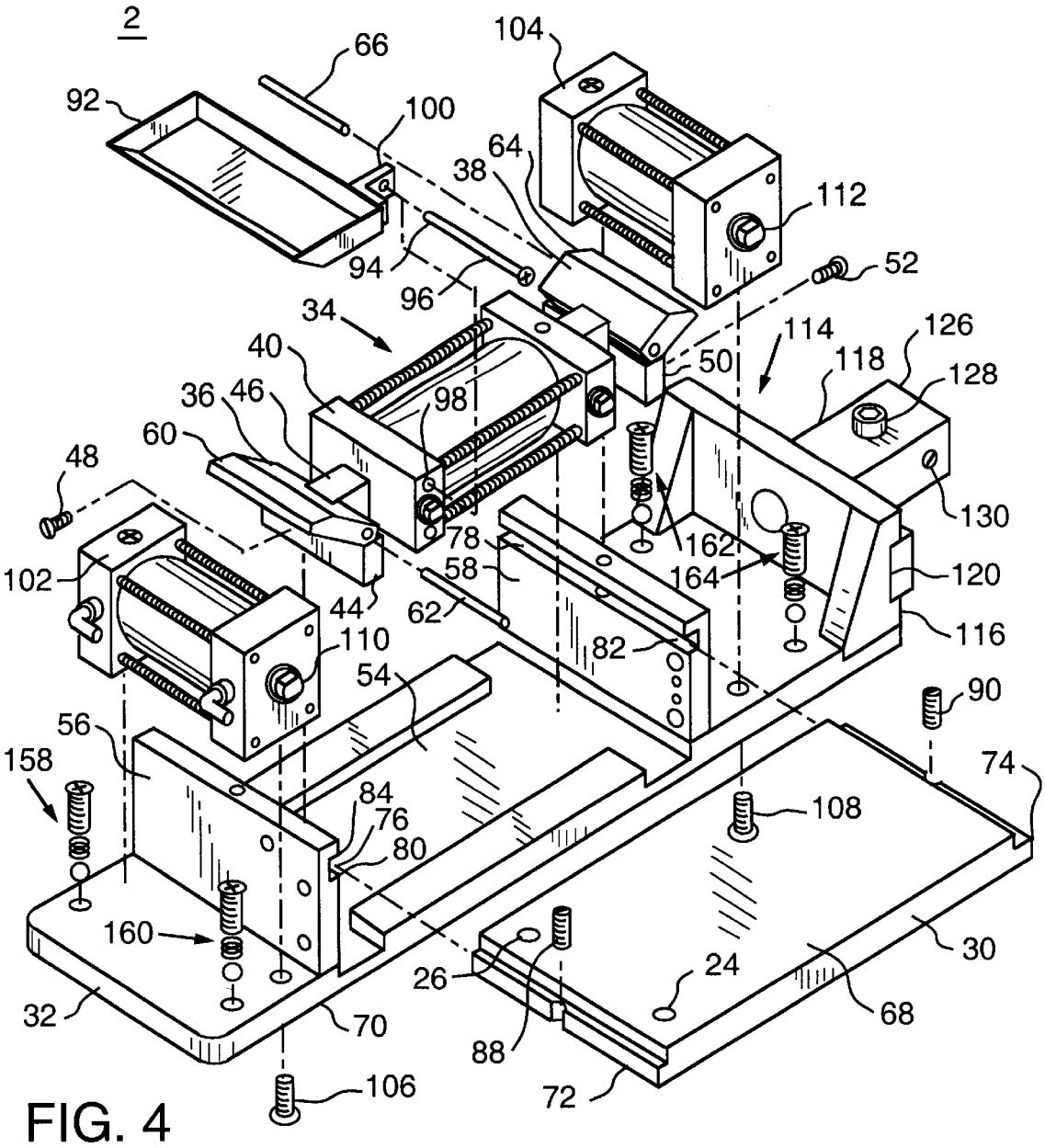
FIG. 4 is an exploded view of the expandable die shown in FIG. 2.

FIGS. 2 through 5 illustrate details of expandable die 2. Referring to FIGS. 2 through 4, expandable die 2 consists of die member 30 which is opposingly disposed relative to base member 32. Expansion mechanism 34 is interposed between die and base members 30, 32 and is operable to vary the distance between die and base members 30, 32.

In this embodiment, expansion mechanism 34 consists of first and second cams 36, 38 and double-acting cylinder 40. Piston 42 of double-acting cylinder 40 is connected to first cam lower portion 44 by way of spacing block 46 and first bolt 48. Second cam lower portion 50 is connected directly to double-acting cylinder 40 by way of second bolt 52. Double-acting cylinder 40 is slidably disposed in channel 54 of base member 32. When double-acting cylinder 40 is activated to extend piston 42, first cam 36 moves longitudinally forward until its motion is arrested by front plate 56 and double-acting cylinder 40 slides longitudinally rearward in channel 54 until second cam 38 is arrested by rear plate 58. During this activation, as first cam upper section 60 comes in contact with front plate 56, it begins to rotate upwardly around first cam connecting pin 62. Similarly, as second cam upper section 64 comes into contact with rear plate 58, it begins to rotate upward around second cam connecting pin 66. The upward rotations of first section cam section 60 and second cam upper section 64 cause die member 30 to moved outwardly away from base member 32. This expands expandable die 2 bringing die member outer surface 68 and base member outer surface 70 into supporting contact with adjacent inside surfaces of the elongate hollow body. Preferably, outer surfaces 68, 70 are contoured to match the contours of the respective adjacent inside surfaces of the elongate hollow body 14. Reversing the operation of double-acting cylinder 40 withdraws piston 42 from its extended position causing first cam 36 to move longitudinally rearward and double-acting cylinder 40 along with second cam 38 to move longitudinally forward. These movements cause first cam upper section 60 and second cam upper portion 64 to rotate downwardly around, respectively, first and second cam pins 62, 66. These downward rotations have the effect of moving die member 30 inwardly toward lower member 32 thus releasing outer surfaces 68, 70 of die and base members 30, 32, respectively, from supporting contact with adjacent inside surfaces of the surrounding elongate hollow body 14.

Figure 5A:
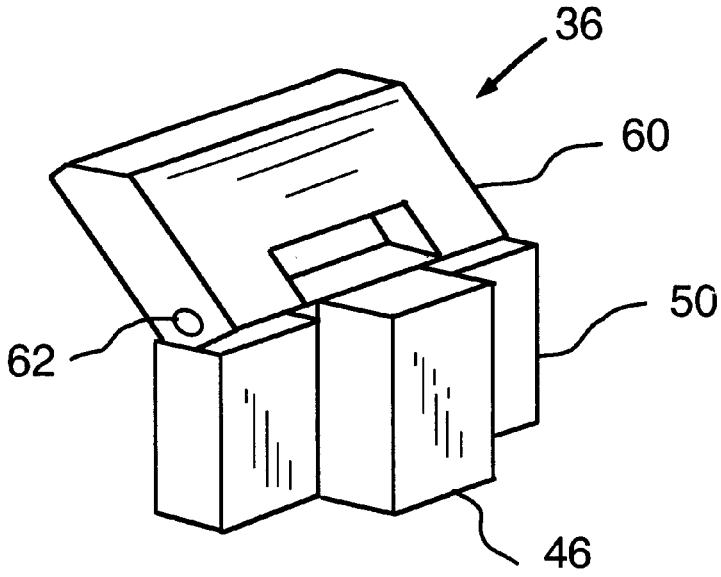
FIG. 5A is a perspective view of a cam of the expandable die of FIG. 2, shown in a retracted state.
Figure 5B:
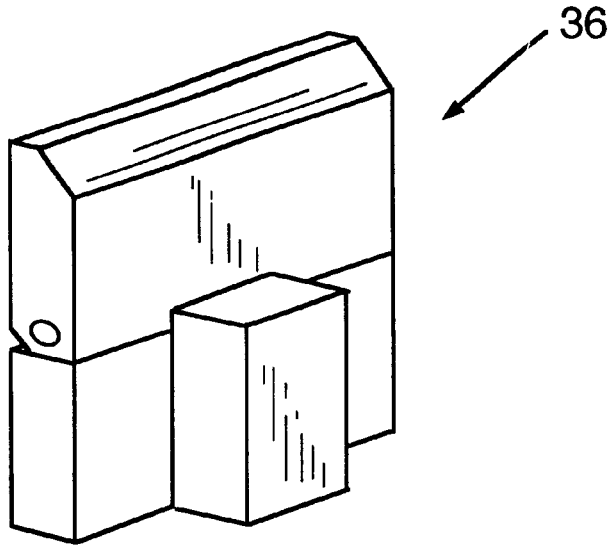
FIG. 5B is a perspective view of a cam of the expandable die of FIG. 2, shown in an activated position.

First cam 36 is illustrated in more detail in FIGS. 5A and B. First cam 36 is shown in a retracted state in FIG. 5A and in an activated state in FIG. 5B.

Referring again to FIGS. 2 through 4, front and rear lips 72, 74 of die member 30 are movably disposed within, respectively, front and rear plate grooves 76, 78. Bottom surfaces 80, 82 of front and rear plate grooves 76, 78 limit the inward motion of die member 30 and top surfaces 84, 86 of front and rear plate grooves 76, 78 limit the outward motion of die member 30. Thus, the thicknesses of front and rear lips 72, 74, and the heights of front and rear plate grooves 76, 78 cooperatively determine the expandability range of the expandable die 2 in the punching direction in this embodiment. Front and rear guide pins 88, 90 restrict the lateral motion of die member 30 without interference to its motion in the punching direction.

Receptacle 92 is disposed so as to receive the punch press punch offal created during the punching operation from first and second die cavities 24, 26 of die member 30. Receptacle 92 is secured in place during operation by inner extension 94 of a handle in the form of rod 96 which is received by aperture 98 of expansion double-acting cylinder 40. Handle 96 is attached to receptacle 92 by way of tab 100.

First and second lateral positioning double-acting cylinders 102, 104 are attached to base member 32 by third and fourth bolts 106, 108, respectively. When activated, first and second lateral positioning double-acting cylinder pistons 110, 112 extend outwardly from first and second lateral positioning double-acting cylinders 102, 104, respectively, to engage an adjacent sidewall of the elongate hollow body 14 thereby forcing expandable die 2 to move laterally until it is arrested by the opposing sidewall of the elongate hollow body 14. This action brings first and second die cavities 24, 26 into lateral alignment with first and second punches 18, 20. Reversing the operation of first and second lateral positioning double-acting cylinders 102, 104, causes their respective pistons 110, 112 to withdraw inwardly away from the adjacent sidewall of the elongate hollow body 14.

Referring to FIG. 1, expandable die 2 attaches to positioning bar 8 by way of support bracket 114. Referring again to FIGS. 2 through 4, support bracket 114 comprises bracket plate 116 and tee-block 118. Tee-block 118 fits into recess 120 of bracket plate 116 and is bolted to bracket plate 116 by way of fifth and sixth bolts 122, 124. Support extension 126 of tee-block 118 connects to of the free end of positioning bar 8. First and second attachment bolts 128, 130 are used to secure together support extension 126 and positioning bar 8.

Referring to FIG. 1, positioning bar 8 is used to longitudinally align first and second die cavities 24, 26 with first and second punches 18, 20. This alignment is facilitated by adjusting longitudinal adjustable connector 12 to move positioning bar longitudinally forward or rearward as needed and then locking longitudinal connector 12 to preserve this longitudinal alignment during the punching operation. Positioning bar 8 may be an open or closed-sided hollow body or a length of structural angle or other structural shape.

Positioning bar 8 also carries the power lines which power the operational expansion and lateral positioning components of expandable die 2. For the sake of clarity, representations of power lines 134–144 which bring power to cylinders 40, 102, 104 have been omitted either completely or in part from most of the drawings.

Referring to FIGS. 3A and B, first and second power lines 134, 136 operatively connect with second lateral positioning double-acting cylinder 104. Power lines 138–144 pass through openings 146–152 in rear plate 58. Third and fourth power lines 138, 140 operatively connect with expansion double-acting cylinder 40. Fifth and sixth power lines 142, 144 pass through openings 154,156 in front plate 56 and operatively connect to first lateral positioning double-acting cylinder 102.

Referring to FIGS. 2 and 3A and B, main conduit 132 extends through support extension 126 and bracket plate 116. Main conduit 132 permits power lines 134–144 to pass through from positioning bar 8 to cylinders 40, 102, 104.

Cylinders 40, 102, 104 in the embodiment illustrated in FIGS. 2 through 4 are pneumatic powered cylinders. However, those skilled in the art will recognize that other types of expansion devices, for example, without limitation, electric or hydraulic powered cylinders, may be used. The operation of the cylinders 40, 102, 104 are controlled using power control valves known to those skilled in the art which are operated by a single control, such as control 28, or by multiple controls. The operation of cylinders 40, 102, 104 is sequenced so that the lateral alignment of expandable die 2 with the punches of the punch press is completed before die and base members 30, 32 make supporting contact with the adjacent inside surfaces of the elongate hollow body.

To facilitate the mobility of expandable die 2 relative to hollow body 14, base member 32 may be fitted with a plurality of rollers. Referring to FIG. 4, the rollers in this embodiment comprise spring-biased balls, such as first, second, third, and fourth rollers 158–164, which extend beyond the base member outer surface 70 when expandable die is in the retracted state, i.e., contracted state, and which are forced to recede to the level of base member outer surface 70 by the expansion of expandable die 2 against top and bottom interior surfaces of the elongate hollow body.

An embodiment of a method of the present invention includes the steps of (1) longitudinally aligning an expandable die with respect to the punch or punches of a punch press; (2) inserting the expandable die into an elongate hollow body; (3) activating the expandable die so that the punch-receiving die cavity or cavities of the expandable die become laterally aligned with the punch or punches of the external die press and so that the die and base members of the expandable die come into supporting contact with the inside surfaces of the elongate hollow body; and (4) operating the punch press so that one or more holes are punched through the wall of the elongate hollow body. The elongate hollow body can then be moved to the next position where a hole or set of holes are to be punched. Preferably, the expandable die is retracted after step (4) so as to make it easier to move the elongate hollow body in relation to the expandable die.

Figure 6A:
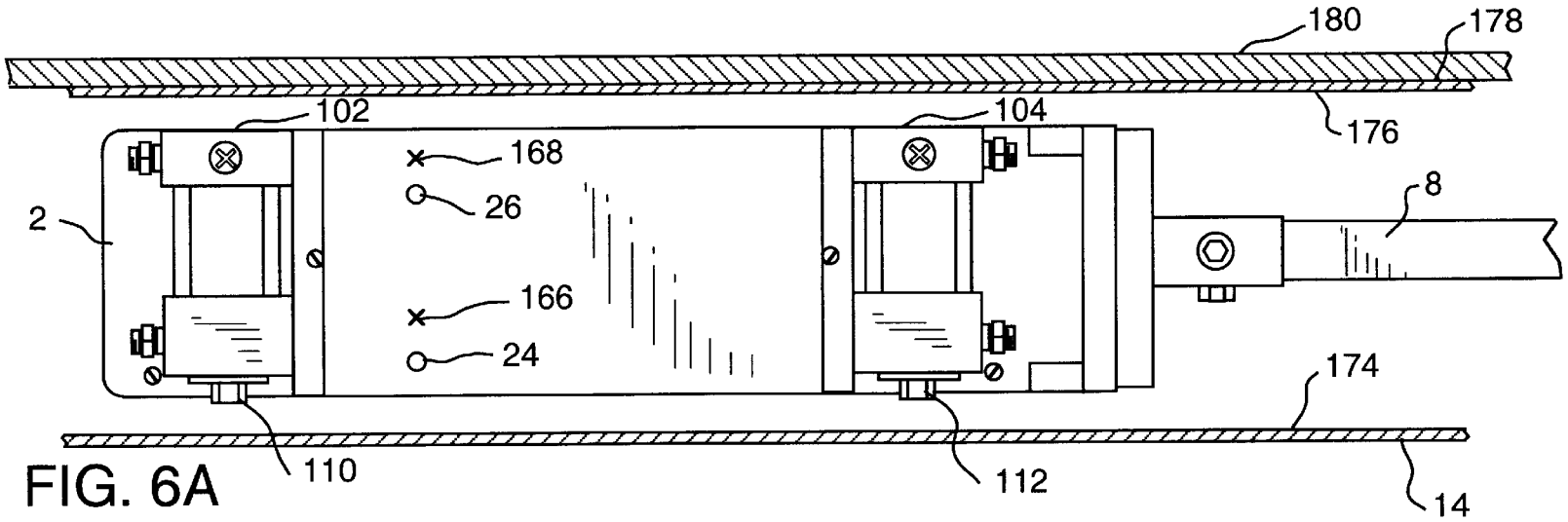
FIG. 6A is a cross-sectional top view schematic of the operation of an embodiment of the present invention showing an embodiment of the expandable die in a retracted state and out of lateral alignment with the punches of an external punch press.

This method is illustrated in FIGS. 6 and 7 with regard to the operation of expandable die 2. FIGS. 6 and 7 show, respectively, top and side views of expandable die 2 in retracted and activated states inside of hollow body 14 into which holes are to be punched. Referring to FIG. 6A, expandable die 2 is shown as having been inserted into hollow body 14 in the retracted state. The locations of first and second punches 18, 20 are indicated in FIGS. 6A and B by first and second Xs 166, 168. As shown, first and second die cavities 24, 26 are longitudinally aligned with first and second punches 18, 20, but they are not yet laterally aligned with these punches. As explained above, the longitudinal alignment is established by positioning bar 8, and is preferably facilitated through the use of a longitudinally adjustable connector 12 at the distal end of positioning bar 8.

Figure 6B:
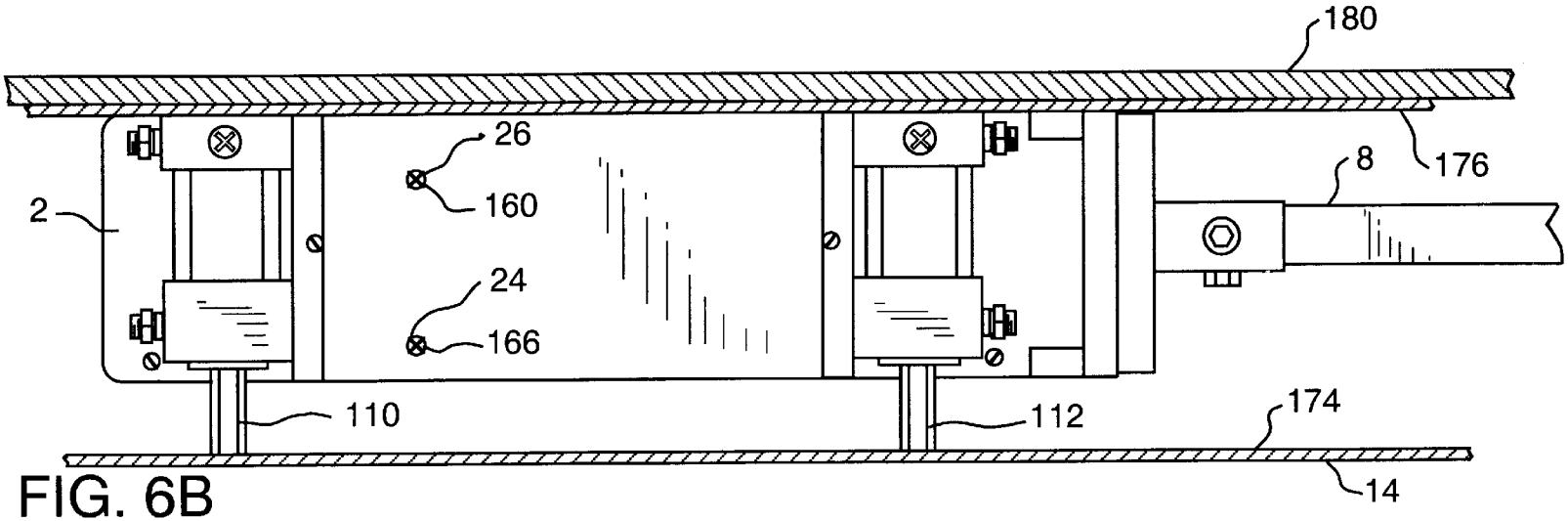
FIG. 6B is a cross-sectional top view schematic of the operation of an embodiment of the present invention showing an embodiment of the expandable die in an activated position and in alignment with the punches of an external punch press.
Figure 7A:
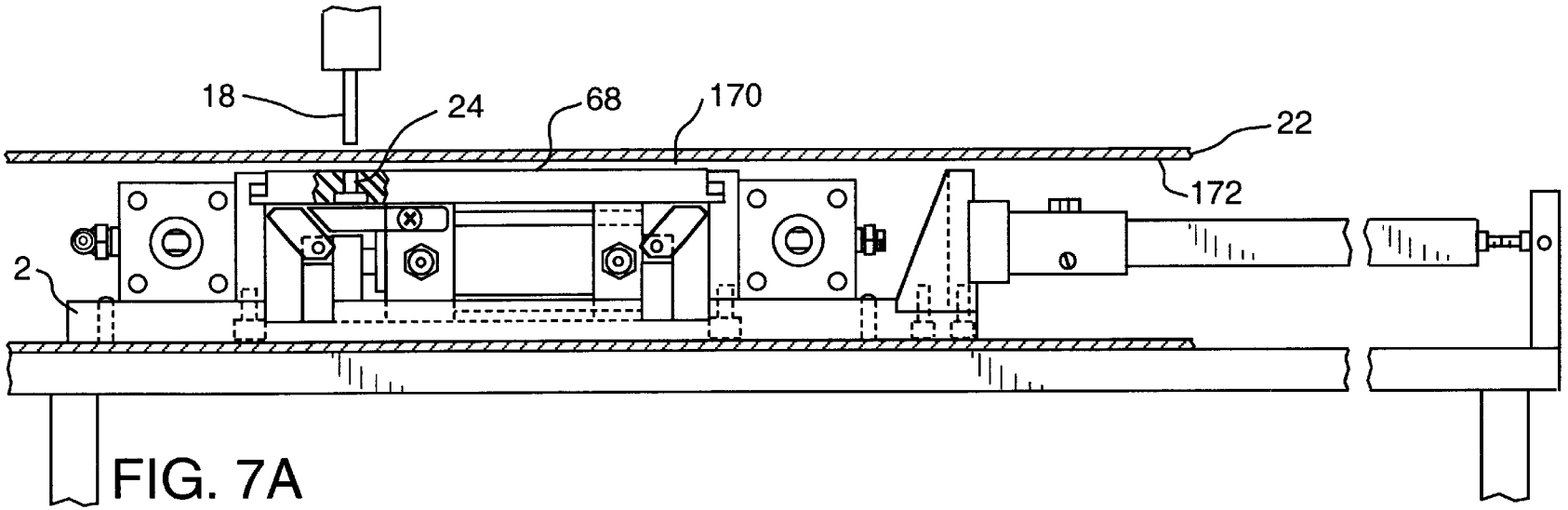
FIG. 7A is a cross-sectional side view schematic of the operation of an embodiment of the present invention showing the expandable die in a retracted state.

Referring to FIG. 7A, a punching direction clearance 170 preferably exists between die member outer surface 68 and hollow body top inner surface 172 to facilitate the mobility of expandable die 2 within hollow body 14. Referring to FIG. 6B, during activation of expandable die 2, pistons 110, 112 of first and second lateral positioning cylinders 102, 104, respectively, extend outwardly to contact right sidewall 174 of hollow body 14 thereby forcing expandable die 2 to move laterally against left sidewall 176 of hollow body 14. This brings first and second die cavities 24, 26 into lateral alignment with first and second punches 18, 20 as is indicated in FIG. 6B by the superposition of first and second Xs 166, 168 on first and second die cavities 24, 26, respectively. The achievement of the lateral alignment may be facilitated by placing left outer surface 178 of hollow body 14 in longitudinal contact with guide 180.

Figure 7B:
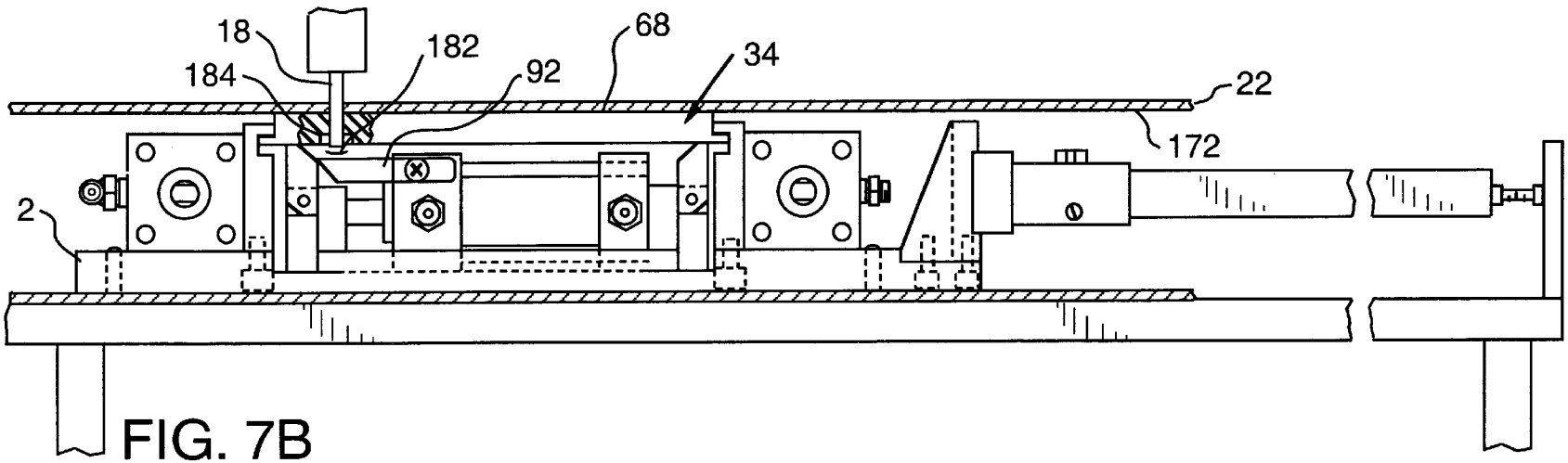
FIG. 7B is a cross-sectional side view schematic of the operation of an embodiment of the present invention showing the expandable die in an activated position.

Referring to FIG. 7B, expansion mechanism 34 then brings die member outer surface 68 into supporting contact with hollow body top inner surface 172. Although only first punch 18 and first die cavity 24 are illustrated in FIGS. 7A and B, one skilled in the art will understand that first and second punches 18, 20 depicted in FIG. 1 both descend and punch through hollow body top wall 22 and into first and second die cavities 24, 26, and then ascend to their original positions. Still referring to FIG. 7B, first punch 18 is shown during the punching operation depositing punch offal slug 182 into receptacle 92. Preferably, the die cavities are designed to include a stripper, for example, without limitation, stripper 184, to ensure that the punch offal is removed from the end of the punch.

After the punching has been completed, expandable die 2 is preferably retracted by withdrawing pistons 110, 112 of first and second lateral positioning cylinders 102, 104, respectively, and causing expansion mechanism 34 to move die member outer surface 68 out of supporting contact with hollow body top inner surface 172. Hollow body 14 may then be manually or automatically indexed longitudinally to bring the next location that is to be punched into alignment with first and second punches 18, 20. Retraction of expandable die 2 is preferred, but is not necessary in those cases where movement of hollow body 14 relative to expandable die in the expanded state can be done without causing damage to either hollow body 14 or expandable die 2.

The order of the steps of the above-described method may be altered so long as the die cavity or cavities are positioned to receive the punch or punches of the external press at the time when the press is operated to punch one or more holes through the wall of the elongate hollow body. For example, without limitation, the step of longitudinally aligning the expandable die with respect to the punch or punches of the external press may be performed either before or after the expandable die has been inserted into the elongate hollow body. Similarly, the step of laterally aligning the expandable die can be performed before or after the expandable die has been longitudinally aligned with respect to the punch or punches of the external die press.

The expandable die may be constructed out of any material which one skilled in the art would find suitable for the application for which the expandable die is to be used. Where the elongate hollow bodies that are to be punched are aluminum, it is preferred that the expandable die be constructed out of steel and the die member in the region of the die cavity or cavities is preferably tempered to a hardness which is the same as that of the punch or punches the expandable die is to be used with.

The positioning bar may be made of any material which one skilled in the art would find suitable for the application, but is preferably made of a lightweight, stiff material, for example, without limitation, extruded aluminum.

It is to be understood that the expandable die may take on forms other than that which is described in conjunction with the preferred embodiment.

Likewise, the expansion mechanism may take on forms other than that which is described in conjunction with the preferred embodiment. The distinguishing feature of the expansion mechanism is that is operable to move either or both of the die and base members outwardly into supporting contact with adjacent inside surfaces of the elongate hollow body so as to prevent damage to the elongate hollow body during the punching operation and then to move either or both the die and base members inwardly away from these inside surfaces after the punching operation has been completed. In some embodiments, the expansion mechanism includes an expansion engine which provides force to expand the expandable die and a retractable support mechanism which provides support between the die and base members when the expandable die is in an expanded position. In some of those embodiments, such as the preferred embodiment described above, the expansion engine may comprise at least one double-acting cylinder and the retractable support mechanism may comprise at least one cam and at least one of the double-acting pistons may be movably or pivotably affixed to at least one of the cams. As a further non-limiting illustration, in some embodiments the expansion mechanism comprises a plurality of double-acting cylinders situated so as to cause the expansion mechanism to exert a substantially uniform expansion force upon the surfaces of the die and base members which come into supporting contact with the elongate hollow body.

Similarly, it is to be understood that the lateral positioning mechanism may take on forms other than that which is described in conjunction with the preferred embodiment. The distinguishing feature of the lateral positioning mechanism is that it is operable to move the expandable die laterally so as to bring the punch-receiving die cavities of the die member into lateral alignment with the punches of the punch press.

While only a few presently preferred embodiments of the invention are described, it is to be distinctly understood that the invention is not limited thereto but may be otherwise embodied and practiced within the scope of the following claims.

What is claimed is:

1. An internal expandable die for use with an external punch press having at least one punch to perforate a wall of a hollow elongate body in which said internal expandable die is situated, said internal expandable die comprising:

a) a die member having an upper surface and at least one die cavity for receiving the at least one punch of the external punch press;

b) a base member having a lower surface;

c) at least one lateral positioning powered cylinder for moving said internal expandable die in a direction that is perpendicular to both the axial direction of any of said at least one die cavity and to the longitudinal axis of the hollow elongate body to align said at least one die cavity with the at least one punch along a lateral axis of the hollow elongate body;

d) at least one expansion controlling powered cylinder for reversibly moving said die member and said base member apart to bring the upper surface of said die member and the lower surface of said base member, wherein said upper and lower surfaces, when expanded, form outermost surfaces of the expandable die such that said upper and lower surfaces can be moved into and out of supporting contact with the interior surface of the hollow elongate body; and e) a positioning bar for aligning said at least one die cavity with the at least one punch along the longitudinal axis of the hollow elongate body, said positioning bar having a proximal end connected with at least one of said base member and said die member and a distal end for spatially fixing the positioning bar in relation to the at least one punch.

2. The internal expandable die of claim 1, wherein any of said at least one lateral positioning powered cylinder is selected from the group consisting of a hydraulically powered cylinder, an electrically powered cylinder, and a pneumatically powered cylinder.

3. The internal expandable die of claim 1, wherein any of said at least one expansion controlling powered cylinder is selected from the group consisting of a hydraulically powered cylinder, an electrically powered cylinder, and a pneumatically powered cylinder.

4. The internal expandable die of claim 1, wherein any of said at least one lateral positioning powered cylinder is a double-acting powered cylinder.

5. The internal expandable die of claim 1, wherein any of said at least one expansion controlling powered cylinder is a double-acting powered cylinder.

6. The internal expandable die of claim 1, further including a cam, said cam being driven by said at least one expansion controlling powered cylinder and providing retractable support between said die member and said base member when the upper surface of said die member and the lower surface of said base member are in supporting contact with the interior surface of the hollow elongate body.

7. The internal expandable die of claim 1, further comprising at least one spring-biased roller disposed in the lower surface of said base member.

8. The internal expandable die of claim 1, further comprising a receptacle disposed below said at least one die cavity to receive punch offal.

9. The internal expandable die of claim 1, wherein the distal end of said positioning bar includes adjusting means for adjusting the positioning bar in relation to the at least one punch.

10. A method for perforating a wall of a hollow elongate body comprising the steps of:

a) positioning the wall of the hollow elongate body between a die press having at least one punch and an internal expandable die having at least one die cavity so that the die press is external to the hollow elongate body and the internal expandable die is inside the hollow elongate body;

b) using a positioning bar of the internal expandable die to align the at least one die cavity with the at least one punch along the longitudinal axis of the hollow elongate body;

c) activating at least one lateral positioning powered cylinder of said internal expandable die to align the at least one die cavity with the at least one punch along a lateral axis of the hollow elongate body;

d) activating at least one expansion controlling powered cylinder of the internal expandable die to move apart a die member of the internal expandable die and a base member of the internal expandable die so as to bring a top surface of the die member and a bottom surface of the base member into supporting contact with the inside surface of the hollow elongate body; and e) operating the die press to first advance the at least one punch through the wall of the hollow elongate body and into the at least one die cavity and then to withdraw the at least one punch from the at least one die cavity and from the wall.

11. The method of claim 10, further comprising the step of retracting the internal expandable die.

12. The method of claim 11, further comprising the step of repositioning the wall of the hollow elongate body so that the at least one punch is operably aligned with a location on the wall where at least one additional perforation is to be made in the wall.

* * * * *